United States Patent [19]

Bähker et al.

[11] 4,087,066

[45] May 2, 1978

[54] TRAIN PROTECTION AND CONTROL SYSTEM

[75] Inventors: Friedrich Bähker, Brunswick; Ernst Jürgen Köhler, Brunswick, Veltenhof, both of Germany

[73] Assignee: Siemens Aktiengesellschaft, Berlin & Munich, Germany

[21] Appl. No.: 805,307

[22] Filed: Jun. 10, 1977

[30] Foreign Application Priority Data

Jun. 28, 1976 Germany ..... 2628905

[51] Int. Cl.[2] ..... B61L 3/12

[52] U.S. Cl. ..... 246/167 R; 246/187 B; 325/37

[58] Field of Search ..... 246/34 R, 34 CT, 167 R, 246/187 B, 4, 5; 179/15 BP; 325/37, 51, 64; 343/225, 226; 340/146.1 BA

[56] References Cited

U.S. PATENT DOCUMENTS

| | | | |
|---|---|---|---|
| 3,639,755 | 2/1972 | Wrege | 246/187 B |
| 3,766,523 | 10/1973 | Brocker | 325/64 |

*Primary Examiner*—Trygve M. Blix
*Assistant Examiner*—Reinhard J. Eisenzopf
*Attorney, Agent, or Firm*—Hill, Gross, Simpson, Van Santen, Steadman, Chiara & Simpson

[57] ABSTRACT

A train safety and control installation utilizing at least one transmitter disposed at the railway right-of-way for the transmission of orders necessary for train traffic control and for the wireless exchange of general information between a track control center and trains moving in the associated right-of-way section, with a data processing installation being provided at the track control center for the cyclical determination of orders in the form of dynamic signals in which the operational availability of the data processing system is monitored at the track control center, whereby at a predetermined operation readiness of the data processing system a pilot sound generator is continuously activated whose signals are supplied for the traction vehicles, a switching device, provided at the track control centers, having an input for receiving control orders, an input for receiving radio message, and an output for selectively supplying either to the transmitter, and apparatus for selectively actuating said switching device in accordance with the type of transmission to be effected, whereby the signals of the pilot sound generator on board the traction vehicle, in conjunction with a separate switching device controls the delivery of received control orders to responsive control apparatus on the traction vehicle.

11 Claims, 2 Drawing Figures

TRAIN PROTECTION AND CONTROL SYSTEM

BACKGROUND OF THE INVENTION

The invention relates to a train protection and control system in which at least one transmitter is provided at the railway right-of-way for the transmission of orders necessary in controlling traffic and for the wireless exchange of general information between a track control center and trains moving in the associated right-of-way section, with a data processing unit being disposed at the track control center and providing a cyclic determination of control orders.

Electrical train reporting systems have been employed in railroad systems, in which orders necessary for the control of the train operations are transmitted by radio. In some installations the exchange of information between the train and right-of-way takes place linearly and in order to determine the location of the trains and for an exchange of information between such trains and a track control center, a line is placed along the right-of-way which is permanently fed with an AC voltage from the track control center, over respective marking points. Such line comprises a pair of unshielded conductors which are crossed at regular intervals whereby they change their position along the track. The crossing points thus formed can be "identified electrically" from the trains by means of inductively coupled receiving coils, the location of the train being determined by counting the respective crossing points.

The corresponding counting result, or intermediate results, can be reported over the line to the track control center, in order to determine additional control orders necessary for proper train movement. Such control orders are determined cyclically at the track control center by a data processing unit and thus regularly issued over the line and received on the trains by means of receiving coils inductively coupled with such line. The transmission of data in such cases is accomplished in accordance with the known principle of holding current. The orders issued by the track control center for reception and evaluation on board the rail vehicles are so designed that even a very short interruption in the transmission of data is identified as a defect and will result, for example, in a positive braking operation. This arrangement insures that a train in motion which is controlled by such a system involving linear train control, can be informed, at a given time from the track control center, about changes in operating conditions. This only insures that limited operating orders can be transmitted with certainty to the trains. In other words, it is insured that the installations protecting the train traffic will have access to the moving trains at all times, even with linear exchange of information between the trains and the track control center.

With the use of available radio channels for the transmission of the necessary traffic control orders from a control center to the moving trains without the use of a line, the above described principle of holding current is not feasible as the known train radio channels occasionally exhibit so-called transmission gaps resulting from atmospheric disturbances or unfavorable topography, whereby the transmission of orders to the trains is interrupted or even impossible. However, the density of information of stationary or variable data of a track section is so low that the low volume of information of the available railroad radio channels is adequate over and above train protection. However, it will be noted in this connection that the known railroad radio channels, i.e. the transmitters along the right of way and the receiving installations on board the trains will be used to a large extent for two-way communication. As a result, orders to be transmitted for train traffic control to the traction vehicles cannot be transmitted continuously, but rather only when a change in orders are involved. In the interim, the railroad radio channel are available for operational functions such as two-way radio communication.

With such an economical utilization of the available railway radio channels, no assurance exists, without problems, that in the event of a change of the operational conditions, especially in the event of a restriction, that the affected train can be informed without delay, as it is not known whether the entire transmission system is in a state of operational readiness for transmission of the required order.

Consequently, the invention is directed to the problem of so supplementing an installation of the type initially described that the radio type control will be effected in a manner similar to a holding current operation and which may be accomplished with a low rate of data for the control of the train traffic, without impeding the operational functions involved in the train radio traffic control.

BRIEF SUMMARY OF THE INVENTION

The problem is solved, in accordance with the invention, in that the availability of the data processing system is determined by means which monitors the issuance of dynamic signals from the data processing unit and actuates a pilot sound generator, along with control signals present on lines under the operation of installation of the track control center, provided for the transmission of orders, whereby the signals of the pilot sound generator, received at the traction vehicle controls by means of separate switching means, the delivery of the orders to the means to be controlled thereby.

The pilot sound signal thus can be utilized in an advantageous manner to provide by, means of a two-way radio communication channel, an operational characteristic similar to that involved with the utilization of a holding current. The pilot sound signal may be used primarily on board the traction vehicles to effect, for example, a disconnection in the event of a failure of the engine control. In the absence of a subordinate train protection system, the operations may be performed, for example, by means of visual type signals or in accordance with an emergency signalling system and/or finally in the positive actuation, an emergency or other braking action.

In the event an additional simple train protection system is also present, supplementing the radio-line train transmission secured by the pilot sound signal, generally in, the event of a failure of a pilot sound signal, restricting orders of the additional train protection system become effective and take over the protection function for the train traffic.

The invention has the important advantage that the railway radio channel available for operational purposes can be so utilized, in a surprising manner, that they may be additionally employed for train control without overloading the available channels by too frequent a transmission of orders, for example, in correspondence to the known principle of holding current, in line-train control with the aid of lines laid along the track, whereby an undesirable limitation of the two-way communication traffic would occur. The orders required for train traffic can be determined at the track control center, in view of the necessary data required, in various ways. Normally, a data processing unit is provided which effects a cyclical determination of the desired orders and which issues during proper operation, orders in telegraphic form by means of dynamic signals. In the event of a failure of the data processing signals, such dynamic signals are not issued, and instead static signals issue which have no informative value. In this connection, in an advantageous embodiment of the invention, the testing installation is designed as a comparator which, in cooperation with a timing circuit, monitors the cyclical arrival of an identification symbol provided at the end of each processing cycle of the data processing unit.

Likewise, by the employment of this advantageous improvement, it is possible, in the event of a failure, to disconnect the pilot sound signal in a very short time following the failure, and thereby signal one or more trains operating in the associated section of right of way that they cannot rely on the transmission, by radio, of a control order. Where the pilot sound signal is transmitted over available two-way communication channels, consideration may be given to the fact that radio transmission to the trains may be interrupted off and on for short periods of time due to atmospheric interferences or disturbances caused by the nature of the terrain and, considering the fact that trains operating in the section of right of way may run at widely varying speeds, it is advantageous to provide on the traction vehicles an intermediate memory for the pilot sound signal, at whose reset input two monitoring means are connected which, after the expiration of a predetermined interval of time, will issue a reset signal in the absence of the reception of a pilot sound signal.

By the utilization of this advantageous feature of the invention, it is possible to avoid the evaluation of interferences of short duration in the radio transmission of the pilot sound signal as a lack of availability of the right of way installations, providing such interferences do not exist for too great a length of time.

In the event the transmission system at the control center includes a control receiver which is coupled to the transmitter antenna, and the control identification signals of such receiver, supplied therefrom when the transmitter is operative, are likewise conducted to the AND member actuating the pilot sound generator, the pilot sound signal need not be transmitted over the two-way radio communication channel. In this embodiment the signals of the pilot sound generator for the train protection and control system can be conducted over an additional transmission channel independently of the radio channel. For example, the rails over which the vehicles operate may be utilized for such a transmission, with the vehicles being provided with additional receiving coils adapted to receive the pilot sound signals, which are coupled inductively to at least one rail of the track. Such transmission of the pilot sound offers the advantage that it is insensitive to atmospheric interference and to the surrounding terrain. Consequently, the installations on board the traction vehicles can be simplified somewhat in view of the path and time-dependent monitoring of the reception of the pilot sound signals.

BRIEF DESCRIPTION OF THE DRAWINGS

In the drawings wherein like reference characters indicate like or corresponding parts.

DETAILED DESCRIPTION OF THE INVENTION

Figure 1:
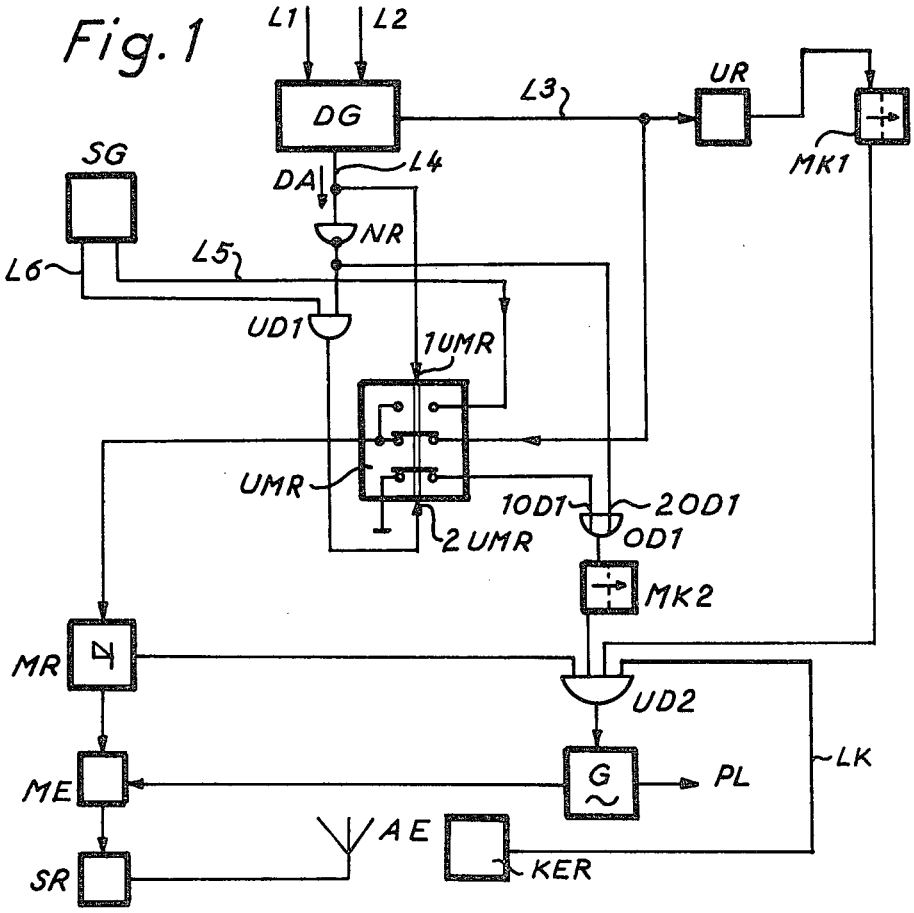
FIG. 1 is a schematic diagram illustrating the circuit of a right-of-way installation for a radio-line train control, utilizing a pilot sound signal for monitoring purposes.

Referring to FIG. 1, the block circuit diagram thereof illustrates, in simplified form, details of a right-of-way protection and control system. Reports received over lines L1 and L2 are supplied to a data processing system DG and processed cyclically for the formation of orders necessary for the control of the train traffic. Such orders are conducted over a line L3, irrespective of whether or not they are new in the individual data messages, to a testing system UR and to a commutator UMR. The data processing system DG then delivers over line L4 a control identification symbol DA to a negator NR and to a control input 1UMR of a commutator UMR, if data messages are to be supplied over conduit L3, in which the data is modified as compared with an earlier data message. The control identification symbol DA may be provided for the duration of one or more data messages. The additional control input 2UMR of the cummutator UMR is connected to the output of an AND member UD1, one input of such AND member being connected to the negator NR.

The commutator UMR is operative to transmit, in the switching position illustrated, data messages conducted from the data processing unit DG over line L3, or in its other switching position, not illustrated, operative to supply other data, for example radio messages, which are received from a transmission control SG over a line L5 to a modulator MR. In addition, the transmission control SG is adapted to be connected for radio operation over a ine L6 to the AND member UD1 and thus may be conducted to the control input 2UMR of the commutator UMR. A connection identification symbol is transmitted over the last mentioned line when two-way radio communication is desired.

The modulator MR is connected to the transmission amplifier SR over a mixer stage ME, with the amplifier feeding an antenna AE, over which information and orders for train control may be supplied, by means of radio, from the track control center to the associated section of track.

The monitoring means UR is operative to determine whether orders and/or order messages were supplied, in the form of dynamic signals, over line L3 by the data processing unit DG, and thus determines the availability of the data processing system. In order to identify this condition, a timing circuit in the form of a retriggerable monostable flipflop stage MK1 receives the output of the monitoring means UR with such stage being in its unstable position in the event the data processing installation DG is available. The active signal supplied in this condition is supplied, over an AND member UD2, to a sound generator G which is controlled thereby, the output signals of which are conducted to a mixer stage ME, from which they are conducted to the transmitter amplifier SR. The presence of the active output signal from the monostable flipflop stage MK1 is operable to prepare the AND member UD2 for a switch-through operation thereof. This preparation does not take place if the monitoring means UR determines that signals on line L3 are no longer dynamic, which is effected in accordance with a time interval predetermined by the time constant of the monostable flipflop stage MK1.

The output of an additional timing circuit, in the form of a monostable flipflop stage MK2, is connected to the input side of the AND member UD2, with the stage MK2 being controlled over an OR member OD1. Preferably this timing circuit likewise is designed as a retriggerable monostable flipflop stage.

However, it is also possible, in a modification of the embodiment illustrated, to transmit the signals delivered by the OR member OD1 with those of the monitoring means UR, conducted over the monostable flipflop stage MK1, to a common AND member (not shown in detail). In this event, the monostable flipflop stage MK2 could be omitted.

One input of the OR member OD1 is connected to the output of the negator NR and the other input is connected over the commutator UMR to ground potential. This last mentioned connection is also present if the commutator UMR is properly operating and if control signals for train protection are being transmitted. In such cases, line L4 carries the control identification symbol DA which is the criterion for the commutator UMR occupying the position illustrated. In such case no identification symbol is present at the output of the negator NR. Consequently, the monostable flipflop stage MK2 is maintained in the unstable position by the signal supplied over the input 10D1 of the OR member OD1.

In the absence of a control identification symbol DA, the input 20D1 of the OR member OD1 receives a signal which maintains the monostable flipflop stage MK2 in its unstable position. The signal at the output of the negator NR is coupled over the line L6 and AND member UD1 to the control input 2UMR of the commutator UMR, operative to effect a switching of the latter into the opposite position thereof not illustrated. As a result of the opening of the corresponding contact by means of the commutator UMR, the input 10D1 of the OR member OD1 is no longer provided with a signal, and with such switching position the other data supplied over line L5 is conducted to the commutator.

If, as a result of a disturbance the commutator UMR no longer follows the signals at the control input 1UMR and/or the input 2UMR, both the inputs 10D1 and 20D of the OR member OD1 are without a signal, so that eventually the monostable flipflop stage MK2 will switch into its stable condition upon expiration of the backdrop or return time thereof. In this condition, the control signal necessary for the AND member UD2 is absent and as a result the pilot sound generator G is disconnected.

The commutator UMR thus is so controlled for the alternate transmission of data of the two-way radio traffic and data for the control of the traction vehicle, that no pilot sound signal will be generated in the event of a defect or failure. Another measure for assuring proper transmission of any orders and/or a proper timely recognition of the availability of the track center for the transmission of data, is achieved by providing means in the modulator MR which with proper modulation will deliver a control signal which may be correspondingly employed to control the AND member UD2.

The line PL at the pilot sound generator G is provided to indicate that the signals of the pilot sound generator need not, in a further modification, be delivered under all circumstances over the radio channel, but may in an advantageous manner also be transmitted over another transmission channel which exists between the stationary installation and the rail-borne vehicles. In this connection a control receiver KER may be provided which is operatively coupled to the antenna AE, whereby with actuation of the transmitter, the control receiver will supply control identification symbols over lines LK to AND member UD2. As a result, generation of the pilot sound signal also is dependent upon the operational efficiency of the transmitter.

In all of the advantageous embodiments of the track installation above described, it is of particular importance that, regardless of the data of the transmission control SG and the data of the data processing unit DG, in the event of predetermined availability of the unit, signals of the pilot sound generator will be transmitted to the vehicles, whereby the evaluation and transmission of the operating orders required for engine or other control is effected independence upon said signals. Additional details in this connection will be discussed in connection with the circuit illustrated in FIG. 2.

Figure 2:
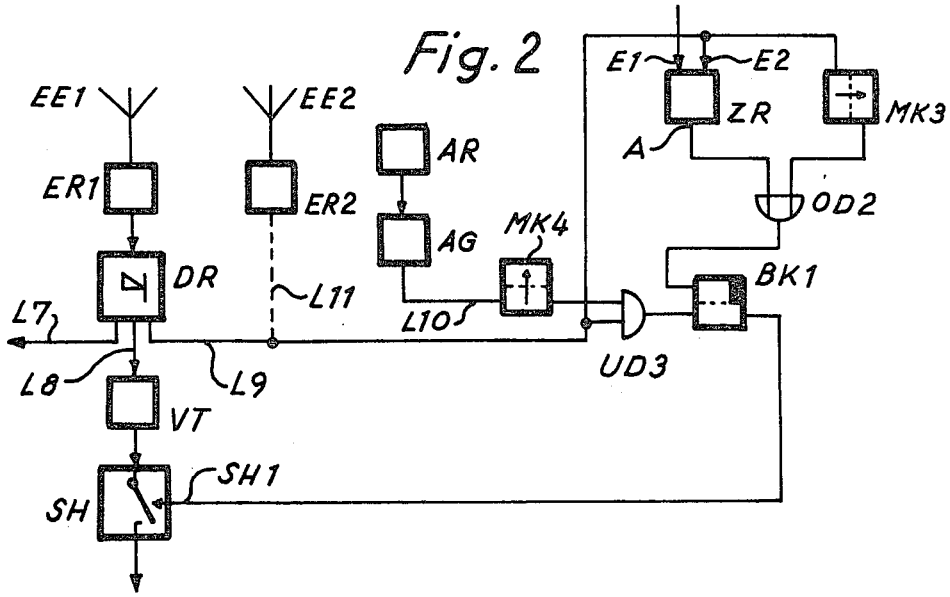
FIG. 2 illustrates a similar schematic diagram of the circuit of an installation on board of a vehicle for evaluating the orders transmitted by radio, particularly that of the pilot sound signal.

The block circuit diagram of FIG. 2 illustrates the essential components on board a traction vehicle for the reception and evaluation of the signals from the track control, and also for processing information transmitted impulsewise. The signals transmitted wirelessly and received by the antenna EE1 are supplied to a receiver ER1 which conrols a demodulator DR. General information involving two-way radio is conducted over line L7 of the demodulator DR, while orders necessary for train control are supplied over line L8 to a processing unit VT, which may be of known type, the details of which are not illustrated as they are immaterial to the explanation of the invention.

A switch SH is connected to the output of the processing unit VT, and with a closed contact thereof, a drive order, for example, will be supplied at the output of the switch SH for engine control. It will be apparent that additional switches may be provided for the supply of additional orders, whereby orders simultaneously issued are separated from one another. The switches are controlled in dependence upon the presence or absence of the transmitted pilot sound signal. The latter and a corresponding digital signal is conducted over line L9 from the demodulator DR to an AND member UD3, the input E2 of a counter ZR and to a monostable flipflop stage MK3. Also, connected to an input of the AND member UD3 is the output of an additional monostable flipflop stage MK4 which stage is in its operating (unstable) position in dependence of the presence of a connection identification symbol transmitted pulsewise at the beginning of the radio-equipped track section. For this purpose a receiver AR for pulse-type information is provided at the traction vehicle and may take the form, for example, of a receiving coil for inductive reception of pulse-like transmission of information supplied from a short conductor loop at the start of the tract section involved. A receiver AG, which includes an evaluation circuit for the pulse-like data, is connected to the receiver AR. The connection identification symbol received is conducted over a line L10 to the monostable flipflop stage MK4 for the control thereof.

A bistable flipflop stage BK1 whose output is connected to the control input SH1 of the switch SH is operatively connected to the output of the AND member UD3 and thus may function as an intermediate memory for the pilot sound signal. The monostable flipflop stage MK4 primarily functions as a storage, of short duration, of the connection identification symbol, while the bistable flipflop stage BK1 is operable to store a control identification symbol to be supplied to the switch SH when the monostable stage MK4 is triggered, in the presence of a pilot sound signal supplied thereto over line L9. Upon triggering of the bistable flipflop stage BK1, the contact of switch SH is closed.

The counter ZR is operative to monitor in a track-dependent manner, the reception of the pilot sound signal, with failures in reception of the pilot sound signal of short duration being inoperative to effect a resetting of the bistable flipflop stage BK1. The counter ZR has two inputs E1 and E2 and a single output A which is connected over an OR member OD2 to the reset input of the bistable flipflop stage BK1. The counter ZR receives over the input E1 line impulses which have been generated for other components (not shown) of the traction vehicle. The counter ZR is maintained in its basic position in the presence of a pilot sound signal or reset, over the input E2 which has blocking characteristics, into the basic position after a failure of the pilot sound signal of short duration. However, if the absence of the pilot sound signal continues for any length of time, during which the train has traveled a predetermined track section, which is dependent upon the setting of the counter ZR as to the total of its count, the counter ZR, upon reaching its terminal position, will supply a signal at the output A which resets the bistable flipflop stage BK1. This reopens the contact in switch SH and disconnects the processing unit VT, whereby a drive order predetermined thereby is incapable of further passage.

The monitoring of the pilot sound signal, on board the traction vehicle, by merely the counter ZR normally is insufficient in itself. In particular, if the traction vehicle is moving at a very slow speed, a failure in the pilot sound signal is recognized only after a longer period of time. Consequently, in addition to a monitoring by the counter ZR of the track-dependent pilot sound signal, an additional time-dependent monitoring is effected by the monostable flipflop stage MK3 the output of which likewise is connected over the OR member OD2 to the reset input of the bistable flipflop stage BK1. The monostable flipflop stage MK3 may be designed, for example, as a retriggerable flipflop stage so that in the presence of a pilot sound signal it is always in the unstable position, in which no reset signal is transmitted to the bistable flipflop stage BK1. Following the failure of the pilot sound signal the monostable flipflop stage MK3 will remain in its unstable position for a predetermined time duration. If the disturbance of the transmission of the pilot sound signal is merely of short duration the monostable flipflop stage MK3 will not return to its stable position, but in the event of a failure for a prolonged period of time, the stable position will be reached and the bistable flipflop stage BK1 will be reset into its indicated basic position.

Assuming that no pulse-like source of information is provided at the start of a radio-equipped track section, the embodiment illustrated in FIG. 2 can be further modified by directly connecting the line L9 with the bistable flipflop stage BK1, in which case the receiver AR, the receiver AG, the monostable flipflop stage MK4 and the AND member UD3 may be omitted. It is also important in such an embodiment that irrespective of the transmission of orders for train control on board the traction vehicles, the operational readiness of the stationary components on board the train is also known, whereby the vehicular installations can rely on being immediately informed of changes in the issuance of orders by radio.

If the pilot sound signal is transmitted over a separate channel and not over the two way radio communication channel, for example over the rails, the additional antenna EE2 which supplies a receiver is connected over a line L11, illustrated in broken lines, to the AND member UD3. The line L9 from the demodulator thus may be omitted in this embodiment.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. In a train safety and control system having at least one transmitter disposed at the railway right-of-way for the transmission of orders necessary for train traffic control and for the wireless exchange of general information between a track control center and trains moving in the associated right-of-way section, with a data processing unit being provided at the track control center for the cyclical determination of orders in the form of dynamic signals, the combination of monitoring means at the track control center for monitoring the issuance of dynamic signals from the data processing unit, to determine the availability of the data processing unit, a pilot sound generator operatively connected to said monitoring means for supplying a pilot sound signal in the presence of such dynamic signals, switching means having an input for receiving control orders, an input for receiving radio messages, and an output for selectively supplying either to the transmitter, and means for selectively actuating said switching means in accordance with the type of transmission to be effected, whereby the signals of the pilot sound generator on board the traction vehicle, in conjunction with separate switching means, controls the delivery of received control orders to responsive control means on the traction vehicle.

2. A system according to claim 1, wherein the monitoring means is operative as a comparator monitoring, in cooperation with a timing circuit, the cyclical arrival of a symbol provided at the end of each processing cycle of the data processing unit.

3. A system according to claim 1, wherein an intermediate memory is provided on board the traction vehicle for storing the pilot sound signal, at whose reset input two monitoring means are provided, one of which is responsive after a predetermined length of the right-of-way has been traveled, and the other upon the absence of a pilot sound signal for a predetermined length of time, operative in either case to supply a reset signal to such intermediate memory.

4. A system according to claim 1, wherein the evaluation of the pilot sound signal, received on board the traction vehicle, is made in dependence upon the reception of a turn-on signal independently transmitted from the track to the traction vehicle at the start of the track section involved.

5. A system according to claim 4, wherein the signals of the pilot sound generator are supplied to the traction vehicle over a transmission channel which is additional to and independent of the radio channel.

6. A system according to claim 4, wherein switch means are provided at the track control center which interrupt the signals of the pilot signal generator during transmission of a predetermined order.

7. A system according to claim 1, wherein the transmission system is provided with a control receiver coupled to the transmission antenna, whose output signals, during transmission operation, are supplied to the means controlling the actuation of the pilot sound generator.

8. A system according to claim 7, wherein the signals of the pilot sound generator are supplied to the traction vehicle over a transmission channel which is additional to and independent of the radio channel.

9. A system according to claim 7, wherein switch means are provided at the track control center which interrupt the signals of the pilot sound generator during transmission of a predetermined order.

10. A system according to claim 1, wherein the signals of the pilot sound generator are supplied to the traction vehicle over a transmission channel which is additional to and independent of the radio channel.

11. A system according to claim 1, wherein switch means are provided at the track control center which interrupt the signals of the pilot sound generator during transmission of a predetermined order.

* * * * *